United States Patent [19]

Blum

[11] Patent Number: 4,562,869

[45] Date of Patent: Jan. 7, 1986

[54] HEAT-STERILIZABLE BLANKET, AND A PROCESS FOR ITS MANUFACTURE

[75] Inventor: Otto Blum, Fussach, Austria

[73] Assignee: Chemie Linz Aktiengesellschaft, Linz, Austria

[21] Appl. No.: 575,934

[22] Filed: Jan. 31, 1984

[30] Foreign Application Priority Data

Feb. 3, 1983 [DE] Fed. Rep. of Germany ..... 3303688

[51] Int. Cl.[4] ..... D03D 11/00

[52] U.S. Cl. ..... 139/413; 139/420 R; 139/426 R; 428/224; 428/259

[58] Field of Search ..... 139/420 R, 420 A, 426 R, 139/384 R, 408–415, 383 A; 428/224, 257–259

[56] References Cited

U.S. PATENT DOCUMENTS

| | | | |
|---|---|---|---|
| 1,792,453 | 2/1931 | Thomas | 139/413 |
| 2,381,214 | 8/1945 | Garner | 139/410 |
| 2,495,847 | 1/1950 | Kerr | 139/426 R |
| 2,754,855 | 7/1956 | Foley | 139/384 R |
| 3,009,489 | 11/1961 | McCrary | 139/413 |
| 4,015,641 | 4/1977 | Goff, Jr. et al. . | |

FOREIGN PATENT DOCUMENTS

| | | | |
|---|---|---|---|
| 191812 | 9/1957 | Austria . | |
| 560433 | 9/1957 | Belgium | 139/384 R |
| 589446 | 12/1933 | Fed. Rep. of Germany . | |
| 2850474 | 6/1979 | Fed. Rep. of Germany . | |
| 1400479 | 4/1965 | France . | |
| WO80/01086 | 5/1980 | PCT Int'l Appl. | 139/383 A |
| 423126 | 4/1967 | Switzerland . | |

OTHER PUBLICATIONS

Textile Practice, vol. 3, 271–274 (1976).

*Primary Examiner*—James Kee Chi

*Attorney, Agent, or Firm*—Wenderoth, Lind & Ponack

[57] ABSTRACT

Heat-sterilizable blanket which has good thermal insulation properties, which is particularly suitable for use in hospitals, old people's homes and hostel institutions, and which comprises a regularly interlaced double cloth into which a wadding pick is additionally incorporated in piquelike fashion and floats over wide stretches. The upper and lower warps and upper and lower wefts of this blanket comprise plain-woven high-twist cellulosic fiber yarns, while the wadding pick is made of a low-twist synthetic fiber yarn having a linear density of 100–1,000 tex. The blanket is shrunk to its final dimensions by washing and drying at temperatures of 100° to 135° C., which at the same time bulks up the blanket and increases its pore volume.

7 Claims, 4 Drawing Figures

HEAT-STERILIZABLE BLANKET, AND A PROCESS FOR ITS MANUFACTURE

Figure 1:
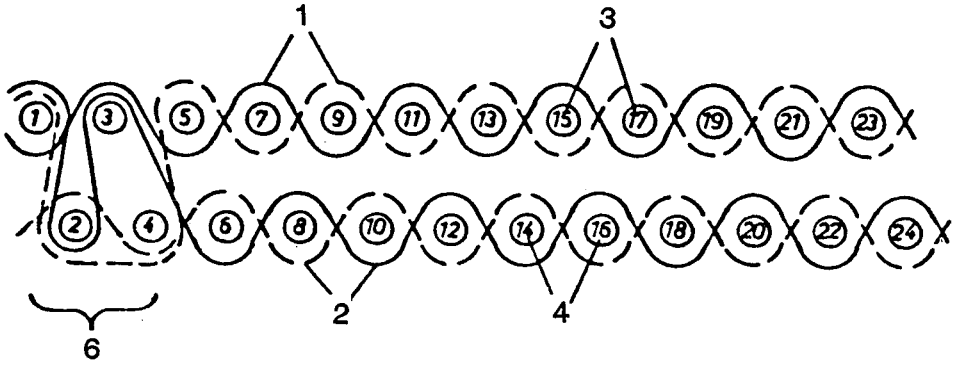
Figure 2:
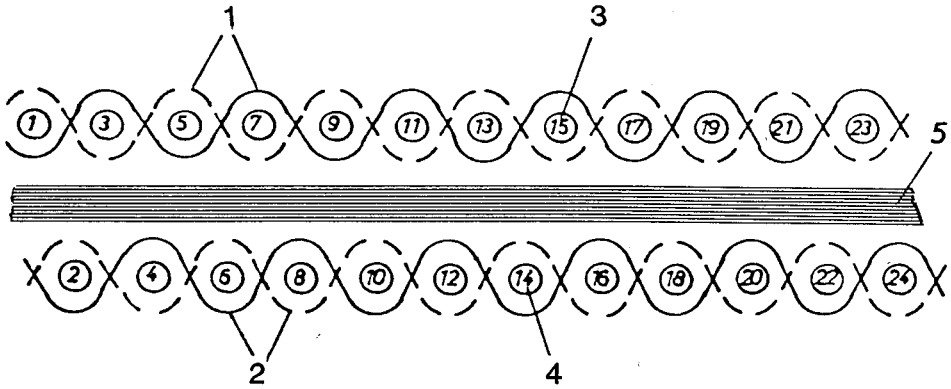

The present invention relates to a heat-sterilizable blanket which is distinguished by good thermal insulation properties and preferably also by a light weight, and is intended for use in hospitals, homes, in particular old people's homes, shelter huts and the like, and to a process for manufacturing this blanket.

Blankets which are to be used in hospitals or hostels need to have, on the one hand, at least a sterilizable surface and, on the other, good thermal insulating properties for one blanket to be sufficient at normal room temperature. The sterilizability of the surface by heat or some form of boiling could hitherto be combined with good thermal insulating properties only by applying appropriately sterilizable slip covers, which increases the weight of the blanket and necessitates a great deal of work if they are changed frequently. This increased weight is of great importance especially in hospitals and old people's homes, since patients cared for there also include those who are sensitive to pressures, in particular at the extremities, and cannot cope with relatively heavyweight blankets. The demand for a light weight and good thermal insulation properties was hitherto likewise not combinable with the simultaneous requirements of pleasant tactility and good absorbency, which can only be met by a surface consisting of cellulosic fibers.

Austrian Pat. No. 191,812 discloses blankets which consist of two woven outside layers and between them a filling thread, and which have good thermal insulation properties by virtue of the hollow spaces between the outside layers. These outside layers are made of a loosely interwoven thick yarn which consists of a material of the type customarily used for blankets, and may also consist of cotton. The blanket is conferred with dimensional stability by the binder yarn inserted between the outside layers—the tensile strength of the binder yarn being higher than that of the yarn from which the outside layers are formed—and interwoven under tension at regular intervals with the outside layers. If the tension is removed after the finishing, the wadding pick contracts and in doing so creates the hollow spaces co-determining the thermal insulation. These blankets have the disadvantage that the thermal insulation properties only persist as long as there is no change in the tension between the wadding pick and the outside layers, for example as a result of washes.

German Offenlegungsschrift No. 2,850,474 furthermore discloses the structure of a double cloth which is made of synthetic fibers and which can be used, for example, for ski clothing, where a latent crimp wadding pick, inter alia, is bound in piquelike fashion at regular intervals between two layers of fabric. The latent crimp is developed by a subsequent wet finish and then fills up the hollow spaces between the layers. There is naturally no provision for boil-washing and sterilizing these materials.

It is the object of the present invention to provide a blanket which can be heat-sterilized as a whole, without requiring a separate slip cover, by washing at the boil and drying at appropriately high temperatures, and which nevertheless has thermal insulation properties which are so good as to survive even a large number of washes at the boil and as to ensure that the blanket can be used at normal room temperature as a single blanket and without a further thermally insulating wrap. The blanket shall further be absorbent and have pleasant tactility and preferably a light weight, so as to be suitable for sensitive patients as well.

This object is achieved with a blanket where a low-twist uncrimped synthetic fiber yarn wadding pick is bound in piquelike fashion into a double cloth with hard-wearing top and bottom layers made of cellulosic fiber yarn, this blanket bulking up, especially on washing, and thereby obtaining good thermal insulation properties.

The subject-matter of the present invention is accordingly a blanket which has good thermal insulation properties and which can be repeatedly sterilized by boil-washing and subsequent treatment at temperatures of up to 135° C. without losing these thermal insulation properties, comprising a double cloth plain-woven from high-twist yarns of high-tenacity cellulosic fibers, and an intermediate wadding pick which is fixed in position between the layers of the double cloth by a regularly spaced piquelike binding of the two layers of the fabric, which floats over wide stretches between the binding points, and which is a low-twist uncrimped synthetic fiber yarn with a linear density of 100 to 1,000 tex.

In this novel structure for a blanket, both the top layer and the bottom layer consist of an absorbent material of pleasant tactility, so that there is no longer a need for a slip cover. These layers are preferably made of a high-twist cotton yarn, and for decorative reasons the top layer may also be given a boilfast shade.

The blanket according to the invention is conferred with thermal insulation properties by the inserted wadding pick which, owing to the piquelike binding chosen, is freely mobile over wide stretches within the double cloth and will therefore bulk up in the course of the first washes at the boil, in which not only the cellulosic fibers but also the synthetic fiber yarn ysed for the wadding pick will shrink, and will give the blanket the desired thickness while increasing the pore volume. This bulking effect is very pronounced in particular when the synthetic fiber yarn, which has no crimp, not even latent crimp, has a linear density of 200 to 500 tex.

In principle, all synthetic fibers which can be used for textile purposes, such as, for example, polyester fibers, acrylic fibers or polyvinyl chloride fibers, are suitable for use as the synthetic fiber yarns to be used according to the invention as wadding pick. However, since the blanket according to the invention has to meet the further requirement of being lightweight, it is advisable to select synthetic fibers having a specific gravity which is as low as possible. Polypropylene yarns have been found to be particularly suitable for this purpose, since not only is their weight very low but their bulking effect is very high. Polypropylene yarns with a linear density of 250 to 333 tex are particularly preferred for use as wadding pick.

As already mentioned, it is very important for obtaining the bulking effect for the wadding pick to lie between the two layers of the double cloth in an unfixed state over wide stretches. This "floating" of the wadding pick is achieved by choosing the pattern of a piquelike binding in which it is advantageous if the hollow spaces which are to be formed, ie. the areas in the blanket where the upper and lower layers of the double cloth are not connected to each other, are at least 5 mm long in the weft direction.

These hollow spaces are most suitably obtained with a honeycomb pique which should preferably be stretched in the warp direction relative to the weft direction, ie. the hollow spaces in the warp direction should preferably be longer than 5 mm and should for example be about 1.8 to 2.5 cm. However, other weaves with the characteristics of a hollow weave as a result of inserting a wadding pick are also suitable.

FIGS. 1 to 4 show an example of a double cloth structure into which a wadding pick is bound in piquelike fashion and which has been found to be particularly suitable for the blanket according to the invention.

Figure 3:
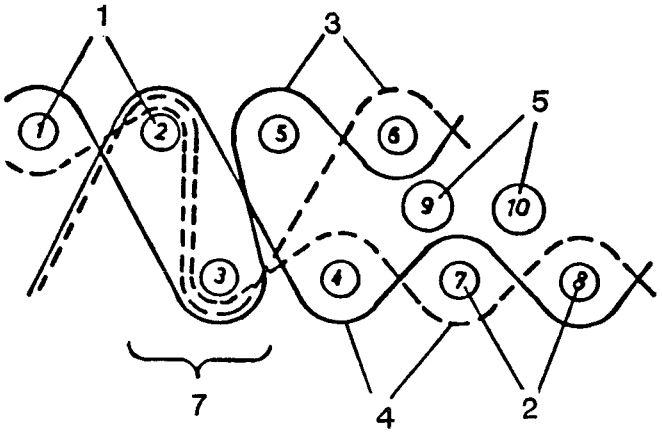
Figure 4:
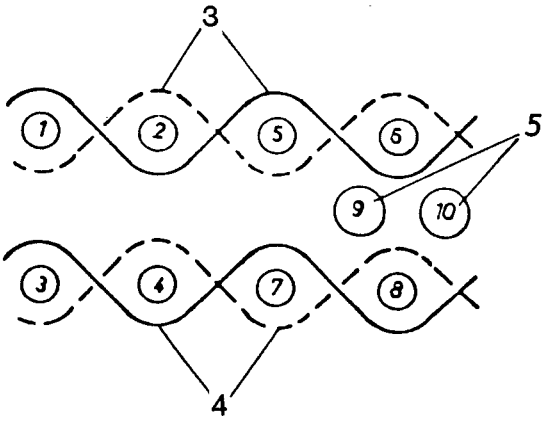

In these figures, 1 denotes the upper weft threads, 2 the lower weft threads, 3 the upper warp threads, 4 the lower warp threads and 5 the wadding pick threads. The broken and solid lines show the respective threads in longitudinal section, the circles indicate the threads in cross-section, and the numbers in the circles are the serial numbers of the warp and weft threads. FIG. 1 reproduces, after the point paper draft design, a warp section at a point where the quilting 6, which is responsible for the piquelike character can be seen. This section shows the 1st, 2nd, 3rd and 4th weft threads and the 1st to 24th warp threads. The warp section reproduced in FIG. 2 was done at the 5th to 8th weft threads and again extends over the 1st to 24th warp threads. This section shows no quilting but instead the 9th and 10th wadding pick threads 5. The floating of the wadding pick 5 is evident from this section. FIG. 3 is a weft section at the 1st to 4th warp threads which extends over the 1st to 8th weft threads. Both the quilting 7 and the 9th and 10th wadding pick 5 are visible. From the 5th to the 24th warp threads the weft section results in the image which is reproduced in FIG. 4. In this case the wadding pick threads 5 and their free floating are again visible, but no quilting. As is apparent from these figures, the fabrics formed from the upper weft 1 and upper warp 3 and the lower weft 2 and the lower warp 4 respectively have no binding between them over long stretches, which fact, together with the floating wadding pick 5 which shrinks on washing at the boil, produces the bulking effect.

The present invention also relates to a process for manufacturing the heat-sterilizable blanket according to the invention by processing the upper weft and upper warp and lower weft and lower warp, each of which is made of high-twist cellulosic fiber yarns which are plain-woven into a regularly interlaced double cloth with additionally piquelike-interlaced wadding pick for which uncrimped synthetic fiber yarn having a linear density of 100 to 1,000 tex is used. Since both the cellulosic fibers and the synthetic fibers used for the wadding pick shrink on boiling, the dimensioning of the unfinished blanket must allow for the subsequent shrinkage. It is usually possible to assume that the final dimensions of the blanket will have become established after at most 10 washes at the boil and subsequent drying at 100° to 135° C., for example in a tumble dryer. Bulking also takes place at the same time, being particularly favorable if polypropylene is used as the material for the wadding pick, so that it is possible to obtain blankets which are about 3 to 5 mm thick although, in principle they only consist of two layers of cotton. The shrinkage of the blanket by the first treatments at the boil is usually about 9 to 12% in the warp direction but about 13 to 17% in the weft direction. The shrinkage does of course depend on various conditions, such as pretreatment of the cellulosic fiber, nature of the yarns, size of the pique patterns and the like, and will need to be predetermined, by means of a test experiment, for each specific combination of materials in those cases where the accurate size of the blanket is of importance. It is an advantage in this connection that the bulking effect does not for example require a separate step or a special finish, but that it arises in the course of the customary utility wash for sterilization purposes and stabilizes after a number of repeats, so that on repeated washing the blanket reaches a state which from then on remains unchanged in the course of many further washes at the boil.

The yarns used can be produced by any conventional spinning method. The cellulosic fibers, for example, can be spun into a yarn with a linear density of about 85 to 25 tex, preferably about 30 tex. The yarn for the wadding pick can likewise be produced on conventional spinning frames, such as open-end spinning frames or ring-spinning frames, but care should be taken to avoid an excessive amount of twist being introduced, because in that case the yarn would become crimped, which is undesirable. The unfinished woven blanket can then be provided with a border in any conventional manner, such as stitching or edging.

The blanket according to the invention offers significant advantages in particular in institutions where a frequent change is necessary. It is specially important that hygiene is fully guaranteed, since the entire blanket can be boiled after every change. The blanket is also labor-saving, since, owing to its fastness to washing and its pleasant tactile nature, it can be used without any slip cover. If constructed with polypropylene as the wadding pick, the blanket is very lightweight while having good thermal insulation properties, so that it is readily acceptable even to sensitive and infirm persons, for example seriously ill or injured patients in hospitals or inhabitants of old people's homes. The fact that a slip cover can be dispensed with is a significant advantage also in respect of the weight. Owing to the nature of the weave the blanket is also porous and hence breathable. It is finally distinguished by especially hard-wearing properties, because easily undone stitching is entirely unnecessary and the surfaces can be made of high-twist yarns, which satisfactorily survive even a large number of washes.

What I claim is:

1. A blanket with surfaces made of absorbent material, having light weight and good thermal insulation properties, which can be repeatedly sterilized by boil washing and subsequent treatment at temperatures of up to 135° C. without losing these thermal insulation properties and therefore can be used without a cover, said blanket comprising a double cloth forming outer layers made of plain-woven cellulosic fibers, and an intermediate wadding pick which is fixed in position between the outer layers by a regularly spaced piquelike binding of the outer layers, which wadding pick floats over wide stretches between the binding points of the piquelike binding and is a low-twist uncrimped polypropylene fiber yarn with a linear density of 100 to 1000 tex.

2. A blanket as claimed in claim 1, wherein the wadding pick has a linear density of 200 to 500 tex.

3. A blanket as claimed in claim 1, wherein the wadding pick has a linear density of 250 to 333 tex.

4. A blanket as claimed in claim 1, wherein the upper and lower wefts and the upper and lower warps comprise high-twist cotton yarn.

5. A blanket as claimed in claim 1, wherein the weave produces hollow spaces which are at least 5 mm long in the weft direction.

6. A blanket as claimed in claim 1, which is bound in a honeycomb pique weave.

7. A blanket as claimed in claim 6, wherein the hollow spaces formed by the honeycomb pique weave are longer in the warp direction than in the weft direction.

* * * * *